US009255440B2

(12) United States Patent
Alexander et al.

(10) Patent No.: US 9,255,440 B2
(45) Date of Patent: Feb. 9, 2016

(54) SCREEN ASSEMBLY

(71) Applicant: HERMAN MILLER, INC., Zeeland, MI (US)

(72) Inventors: Brian Alexander, Douglas, MI (US); Yves Behar, San Francisco, CA (US); Adwait Bhagwat, Holland, MI (US); Jeffrey A. Book, Holland, MI (US); Elindo G. Castro, Jr., Wyoming, MI (US); Noel Carrillo, Grandville, MI (US); Diana Chang, San Francisco, CA (US); Joel R. Dral, Zeeland, MI (US); Naoya Edahiro, San Francisco, CA (US); Michael J. Katje, Grand Haven, MI (US); Bronwyn L. Krohn, Grand Rapids, MI (US); Eileen M. LaMore, Grand Haven, MI (US); Casey Doran Lewis, Highland, UT (US); Qin Li, South San Francisco, CA (US); John T. Matthai, Holland, MI (US); John Moroney, Grand Haven, MI (US); Noah Murphy-Reinhertz, San Francisco, CA (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 14/213,487

(22) Filed: Mar. 14, 2014

(65) Prior Publication Data

US 2014/0311036 A1 Oct. 23, 2014

Related U.S. Application Data

(60) Provisional application No. 61/792,639, filed on Mar. 15, 2013.

(51) Int. Cl.
*E06B 9/24* (2006.01)
*A47G 5/00* (2006.01)

(Continued)

(52) U.S. Cl.
CPC . *E06B 9/24* (2013.01); *A47B 21/04* (2013.01); *A47G 5/00* (2013.01); *A47B 2083/006* (2013.01); *A47B 2200/0079* (2013.01); *E04B 2/7425* (2013.01); *E04B 2002/7483* (2013.01)

(58) Field of Classification Search
CPC . A47G 5/00; E04B 2002/7483; E04B 2/7405; E06B 9/24; A47B 21/04
USPC ..... 160/135, 351, 399, 402, 327, 328; 52/36.1, 239
See application file for complete search history.

(56) References Cited

U.S. PATENT DOCUMENTS 2,981,583 A 4/1961 Eisenberg
3,249,351 A 5/1966 Smith (Continued)

OTHER PUBLICATIONS

International Search Report issued in PCT Patent Application No. PCT/US2014/028012, mailed Jul. 17, 2014, 2 pages.

*Primary Examiner* — Katherine Mitchell
*Assistant Examiner* — Marcus Menezes
(74) *Attorney, Agent, or Firm* — Michael Best & Freidrich LLP

(57) ABSTRACT

A screen assembly includes a core having an edge and first and second opposite side surfaces. A retainer, or edge treatment, is coupled to the edge of the core and extends outwardly from the core. The retainer includes first and second resilient limbs having respective edge portions defining a mouth. First and second cover portions overly the core and exterior surfaces of the retainer. The first and second cover portions wrap around the first and second limbs and are disposed through the mouth such that the edges of the first and second cover portions are retained by the limbs. Various screen supports and accessory interface members also are provided.

20 Claims, 26 Drawing Sheets

(51) Int. Cl.

| | |
|---|---|
| ***A47B 21/04*** | (2006.01) |
| *E04B 2/74* | (2006.01) |
| *A47B 83/00* | (2006.01) |

(56) References Cited

U.S. PATENT DOCUMENTS

| | | | | | |
|---|---|---|---|---|---|
| 4,213,493 | A | * | 7/1980 | Haworth | 160/351 |
| 4,263,761 | A | | 4/1981 | Kristoff | |
| 4,624,083 | A | | 11/1986 | Diffrient | |
| 4,821,477 | A | * | 4/1989 | Rydqvist | 52/239 |
| 5,024,030 | A | * | 6/1991 | Morrison | 52/36.1 |
| 5,339,576 | A | * | 8/1994 | Fussler | 52/71 |
| 5,423,151 | A | * | 6/1995 | Caro et al. | 52/145 |
| 5,531,539 | A | * | 7/1996 | Crawford | 403/381 |
| 5,689,924 | A | * | 11/1997 | Mason | 52/239 |
| 5,733,001 | A | | 3/1998 | Roberts | |
| 5,737,893 | A | * | 4/1998 | Rossiter et al. | 52/481.2 |
| 5,875,596 | A | * | 3/1999 | Muller | 52/239 |
| 5,970,669 | A | * | 10/1999 | Livingston | 52/222 |
| 6,044,982 | A | | 4/2000 | Stuart | |
| 6,141,926 | A | * | 11/2000 | Rossiter et al. | 52/239 |
| 6,499,262 | B1 | * | 12/2002 | Pinchot et al. | 52/273 |
| 6,574,936 | B1 | | 6/2003 | Anderson | |
| 6,599,055 | B2 | * | 7/2003 | Auer et al. | 403/381 |

* cited by examiner

SCREEN ASSEMBLY

This application claims the benefit of U.S. Provisional Application No. 61/792,639, filed Mar. 15, 2013, the entire disclosure of which is hereby incorporated herein by reference.

TECHNICAL FIELD

The present application is directed to a screen assembly, for example and without limitations screen assemblies for use in office environments.

BACKGROUND

It is well known to use screens in different office environments, for example to partition separate workspaces, to act as sound barriers, to provide various display systems, such as marker boards, tack boards, and video screens, and/or to provide and/or increase privacy for various workspaces. Often, such screens are covered with a cover, such as a fabric, on one or both sides thereof, which may allow for customization of the appearance of the screen. The installation of such covers may be difficult, however, requiring the positioning and installation of various splines, caps, adhesives or other extraneous devices.

In addition, screens are often configured with a peripheral frame that provides a finished appearance to the screen and covers the edges of the fabric. Such frames often are difficult to install and increase the overall weight of the screen, thereby making the screens less portable or suitable for installation on desks and other locations.

SUMMARY

Briefly stated, in one aspect, one embodiment of a screen assembly includes a core having an edge and first and second opposite side surfaces. A retainer is coupled to the edge of the core and extends outwardly from the core. The retainer includes first and second resilient limbs having respective edge portions defining a mouth. The first and second resilient limbs define an interior cavity therebetween. The first and second resilient limbs define respective exterior surfaces. The edge portions of the first and second resilient limbs are movable toward and away from each other between a retention configuration and an insertion configuration, wherein the first and second limbs are biased toward the retention configuration. First and second cover portions each have an edge, with the first cover portion overlying the first side of the core and the exterior surface of the first resilient limb, and with the second cover portion overlying the second side of the core and the exterior surface of the second resilient limb. The first and second cover portions wrap around the edge portions of the first and second limbs and are disposed through the mouth such that the edges of the first and second cover portions are disposed in the interior cavity. The first and second resilient limbs retain the first and second cover portions therebetween.

In another aspect, one embodiment of a screen assembly includes a core having a bottom edge and first and second opposite side surfaces, and an edge treatment connected to the bottom edge of the core and extending downwardly from the core. The edge treatment includes opposing first and second limbs defining opposite first and second exterior surfaces. A first cover portion overlies the first side of the core and the first exterior surface of the edge treatment. A second cover portion overlies the second side of the core and the second exterior surface of the edge treatment. The first and second cover portions are held by the first and second limbs. A screen support includes an insert portion extending upwardly between the first and second limbs.

In yet another embodiment, a screen assembly includes a core having an edge and first and second opposite side surfaces, and an edge treatment connected to the edge of the core and extending outwardly from the core. The edge treatment includes opposing first and second limbs defining opposite first and second exterior surfaces and a mouth therebetween. A first cover portion overlies the first side of the core and the first exterior surface of the edge treatment. A second cover portion overlies the second side of the core and the second exterior surface of the edge treatment. The first and second cover portions are held by the first and second limbs. An accessory interface member has an insert portion disposed through the mouth between the first and second cover portions.

The various aspects and embodiments of the screen assembly provide significant advantages over other screen assemblies. For example and without limitation, in one embodiment, the cover can be easily and quickly installed without any extraneous fastening devices, for example splines, covers, etc. Moreover, once installed, the cover provides a continuous and uniform exterior appearance to the screen. In addition, the screen can be made relatively light weight, thereby increasing its portability. At the same time, the screen support can be easily and quickly installed to support the screen without the requirement for additional fasteners and/or connection devices. Likewise, various accessories, including without limitation, screen overlays, document holders, storage devices and the like, can be easily installed and supported by the screen at any location along a length thereof without the need for additional fasteners and/or connection devices.

The present embodiments of the invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "top," "upper," "bottom" and "lower" are intended to indicate directions when viewing a screen when positioned for use. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The term "transverse" means extending across an axis, including without limitation substantially perpendicular to an axis. It should be understood that the use of numerical terms "first," "second," "third," etc., as used herein does not refer to any particular sequence or order of components; for example "first" and "second" portions may refer to any sequence of such portions, and is not limited to the first and second portions of a particular configuration unless otherwise specified.

Screen Assembly

Figure 1:
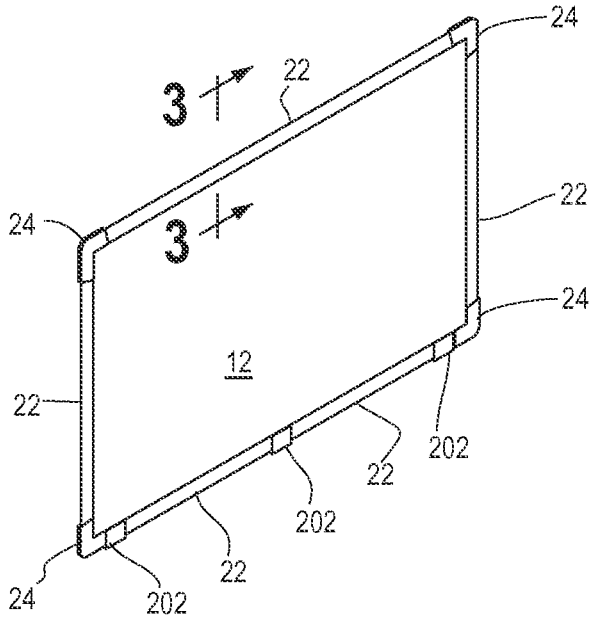
FIG. 1 is a perspective view of one embodiment of a first embodiment of a screen assembly without cover members applied thereto for the sake of clarity.
Figure 2:
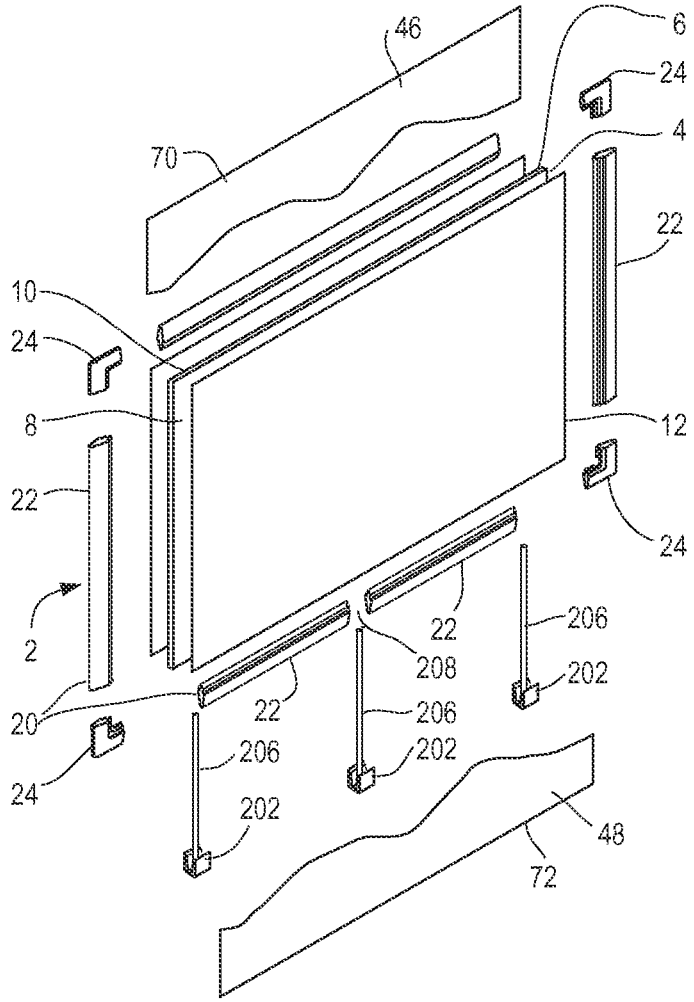
FIG. 2 is an exploded view of the screen assembly shown in FIG. 1 with the covers shown in partial cutaway for the sake of clarity.

Referring to FIGS. 1-3 and 7-15, a screen assembly 2 is shown as including a core 4 having a peripheral edge 6 and first and second opposite side surfaces 8, 10. As shown in FIGS. 1 and 2, the screen assembly may have a rectangular shaped side profile, or may have other non-rectangular quadrilateral or polygonal shapes, as shown for example in FIG. 13. The screen may also have various circular, obround, elliptical, oval, or other shapes. As such, the edges of the screen may be linear, or may be arcuate, or combinations thereof. The core 4 may be made of a single homogenous material, such as a lumber core, fiber board, fiber mat, foam core, including a polyurethane foam with a fiberglass mat filler, or may be formed of a various layers or substrates of such materials. The core may include one or more tackable layers, or sound barrier layers. The core may include an outer scrim 12 applied thereto, for example to provide fire retardant properties.

At least a portion of the peripheral edge, and in one embodiment, the entirety peripheral length of the edge, includes openings 14, 16 extending inwardly therefrom. The openings may be continuous, or spaced apart. In one embodiment, the openings are configured as first and second channels 14, 16 centered in the edge. The channels are nominally centered, but with thickness variances due for example to tolerance allowances, the channels may shift slightly off-center. In other situations, the grooves may be positioned closer to one side or the other as desired. The first channel 14 opens outwardly toward the edge 6 and has a first width. The edge defines a pair of landings 18 on each side of the channel. The second channel 16 extends inwardly from a bottom of the first channel 14 and has a second width, with the second width being less than the first width. In various embodiments, the core 4 is substantially planar, although it should be understood that the core may have a non-planar shape, for example being curved about one or more virtual vertical axes.

Referring to FIGS. 1-3 and 7-25, an edge treatment is coupled to the edge 6 of the core and extends outwardly from the edge, preferably within the same plane defined by the core. In one embodiment, the edge treatment is configured as a retainer 20 that includes a plurality of linear members 22 and a plurality of corner members 24. The linear members are preferably one piece, and are formed as an extrusion. The retainer may also include non-linear curved members that match the profile of the edge of the corresponding core. In one embodiment, the plurality of retainers 20 includes upper and lower retainer members, opposite side retainer members 22 and corner retainer members 24 positioned between the upper retainer member and the side retainer members and between the lower retainer member and the side retainer members. The corner retainer members are connected to the upper and lower retainer members. In one embodiment, one or the other of the corner retainer members and the upper and lower retainer members includes an insert portion 26 that mates with and is received in an opening formed in the other of the corner retainer members and the upper and lower retainer members comprise an opening, configured as an interior cavity 28 of the upper and lower retainer members in one embodiment, wherein the insert portion is disposed in the interior cavity.

Figure 3:
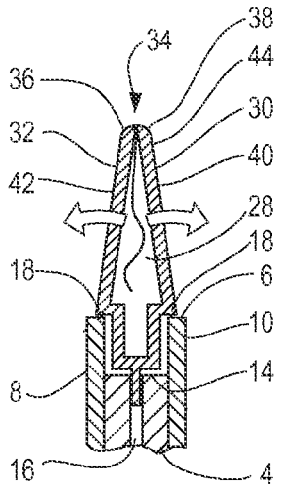
FIG. 3 is a cross-sectional view of the edge portion of the screen assembly taken along line 3-3 of FIG. 1.

The retainer, whether a linear member, a curved member or a corner member, includes first and second resilient limbs 30, 32 having respective edge portions 36, 38 defining a mouth 34, which may be closed, or form a slight gap, when in a retention configuration. The first and second resilient limbs 30, 32 define the interior cavity 28 therebetween. The first and second resilient limbs define respective exterior surfaces 40, 42. As shown in FIG. 3, the edge portions of the first and second resilient limbs 30, 32 are movable toward and away from each other between a retention configuration and an insertion configuration. The first and second limbs are biased together toward the retention configuration when no external forces are applied thereto. The edge portions 36, 38 may be configured to provide different profiles of the outermost edge of the screen assembly. For example, the limbs and edge portions may be shaped and configured to provide a triangular cross-section as shown in FIG. 3. Or the edge portions may be "squared off," and have a relative flat and planar outermost surface.

The first and second limbs 30, 32 each have gripping members 44 extending inwardly into the interior cavity. The gripping members engage first and second cover portions 46, 48, e.g., fabric layers, inserted into the interior cavity 28 respectively. The gripping members 44 are oriented to provide one-way engagement of the cover portions 46, 48, such that the gripping members are configured to permit insertion of cover portions into the interior cavity, but prevent removal of the cover portions from the interior cavity. The gripping members may be configured as hooks, barbs, nodules, or other suitable protuberances. In one embodiment shown in FIG. 15, the gripping members 44 of the first limb 30 are staggered relative to the gripping members of the second limb 32, such that the covers 46, 48 may weave back and forth between the gripping members, thereby maximizing the gripping force exerted on the cover.

Figure 15:
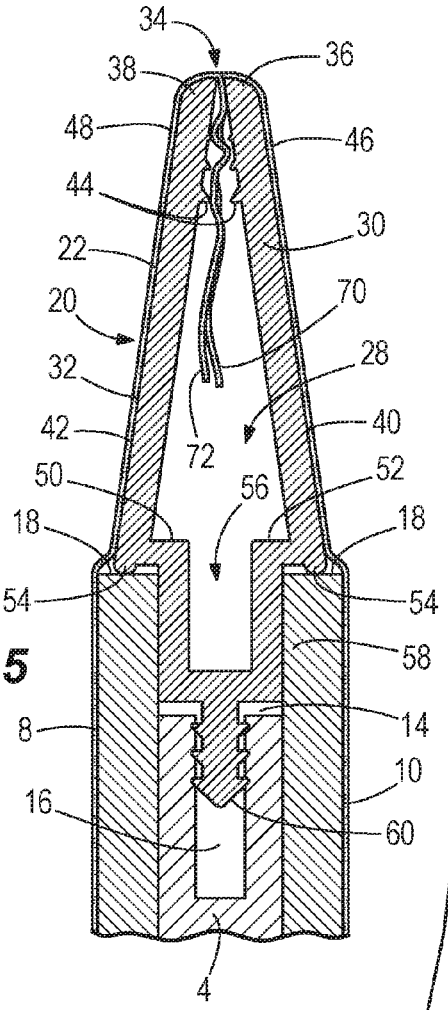
FIG. 15 is an enlarged, partial view of one embodiment of a core and Retainer as shown in FIG. 3.
Figure 16:
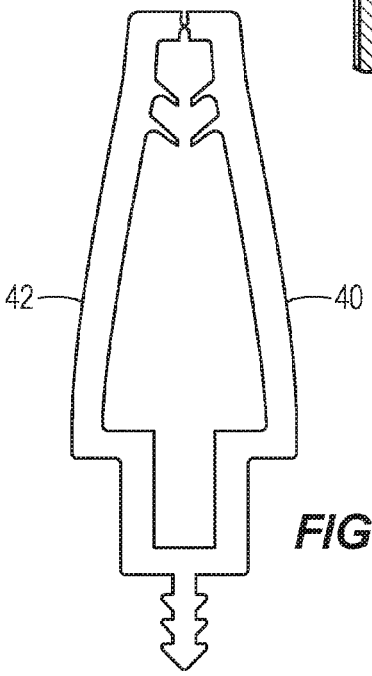
FIG. 16 is an enlarged end view of another embodiment of a retainer.
Figure 17:
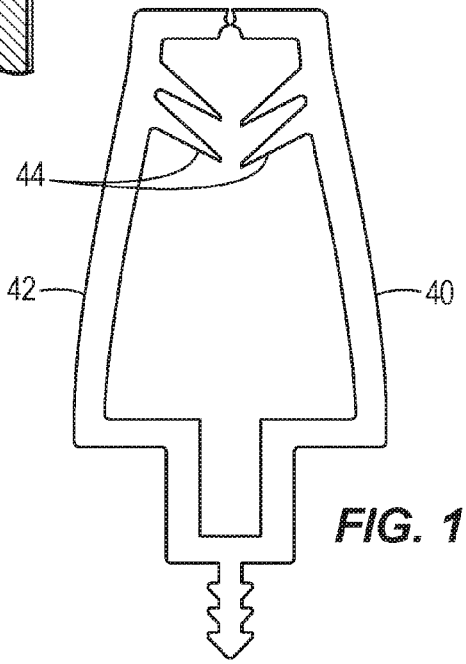
FIG. 17 is an enlarged end view of another embodiment of a retainer.
Figure 18:
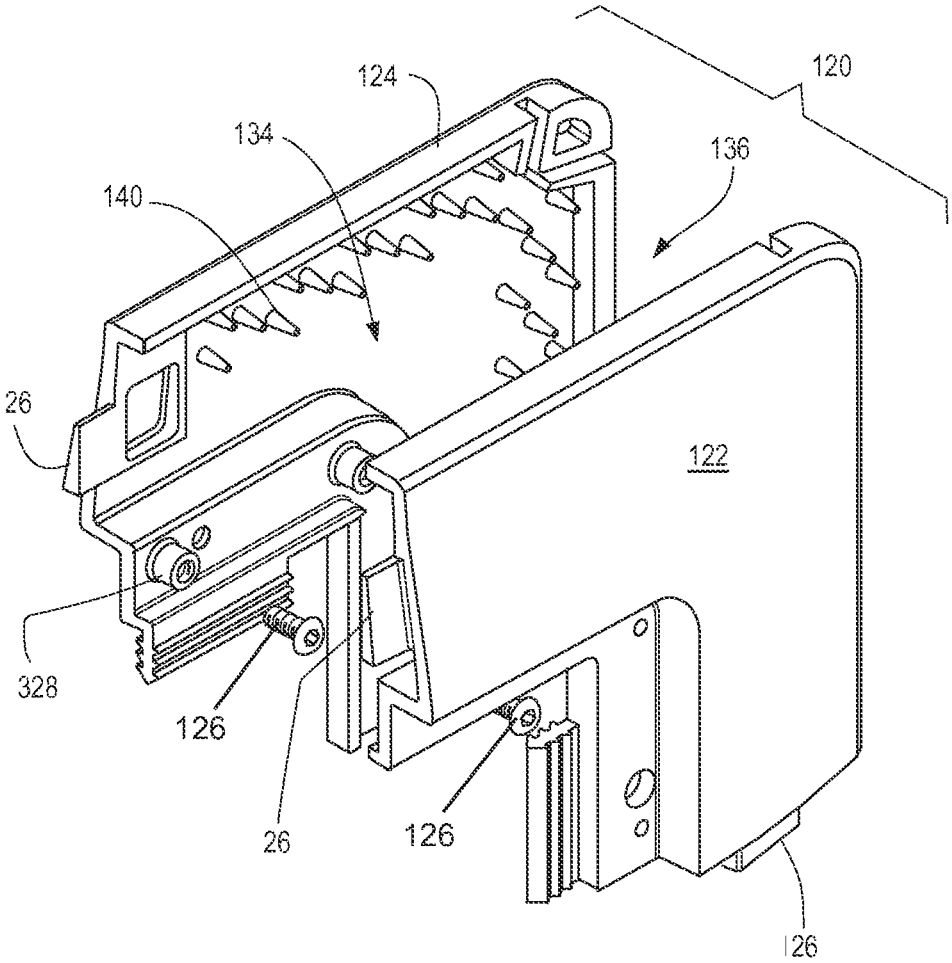
FIG. 18 is an exploded perspective view of corner retainer.

As shown in FIGS. 3 and 15, the exterior surfaces 40, 42 of the limbs are tapered from a base 50 adjacent opposite side surfaces of the core to the edge portions thereof. The exterior surfaces may be substantially planar as shown in FIGS. 3 and 15, or may be curved (concavely or convexly outwardly), or have a non-linear or non-planar profile as shown in FIGS. 8, 12, 16 and 17. The first and second limbs extend outwardly from the base, with the term "outwardly" defined as away from and generally within the profile of the core, e.g., radially "outwardly" from a screen having a circular, side profile. The base has a floor 52, which may include opposite, exterior bumps 54 that engage the landings 18 on the edge 6 of the core, and thereby ensure that the retainer 20 sits properly on the edge, for example due to warping or tolerance buildup along the edge. The base 50 includes an insert member 56 disposed in the channels of the core. The insert member may include a first portion 58 mating with and disposed in the first channel 14 and an anchor member 60 disposed in the second channel 16. The base, including the insert member, and limbs may be integrally formed, for example by extrusion. The width of the base may be varied to accommodate different core thicknesses. In one embodiment, the width of the base is slightly less than the width of the core.

Referring to FIGS. 18-25, the retainer 120 is formed from separate halves 122, 124 each defining one of the first and second limbs 130, 132. The halves may be connected with one or more fasteners, such as screws 126, or by a snap-fit engagement, adhesives, welding, e.g., sonic welding, and/or combinations thereof. The two-piece retainer is shown as being suitable for the corner members, or pieces, which are not suitable for extrusion due to the non-linear configuration. It should be understood that the linear pieces 320, 322, 324 (see FIGS. 6 and 21-25) and also may be made two-piece, and that the corner pieces could be molded as one piece. The linear pieces 322, 324 may be right and left handed, such that a combination of which includes aligned insert portion and anchor portions 330, and lugs 328 that receive fasteners to connect the halves. The corner pieces have first and second limbs 130, 132 that define first and second orthogonal mouth portions 134, 136. Each half is configured with an array of gripping members 140.

Referring to FIGS. 1-3 and 15, first and second cover portions 46, 48 (shown in partial view for the sake of clarity, are shown as each having a peripheral edge 70, 72 with the cover portions have a side profile generally matching the profile of the core and edge treatments, but with the cover portions having a larger surface area with the edge 70, 72 extending beyond the edge portions 36, 38 of the retainers on all sides of the screen. The first cover portion 46 overlies the first side of the core, including an scrim layers, and the exterior surface 40 of the first resilient limb 30. The second cover portion 48 overlies the second side of the core and the exterior surface 42 of the second resilient limb. The first and second cover portions 46, 48 wrap around the edge portions 36, 38 of the first and second limbs and are disposed through the mouth 34 between the edge portions and limbs 30, 32 such that the edges 70, 72 of the first and second cover portions are disposed in the interior cavity 28 wherein the first and second resilient limbs retain the first and second cover portions therebetween. The gripping members 44 of the first and second limbs engage the first and second cover portions. It should be understood that the cover portions may be formed as an integral sheet of material, for example with the cover portion wrapping around a bottom edge of the core and/or edge treatment, and with the free edges of the cover then being secured in retainers along the other three edges of the screen. The cover may also be sealed along the two other sides, or sealed along three sides, e.g. by sewing, with core fitting inside an envelope or bag-like structure formed by the cover. In this embodiment, the cover would include first and second portions formed along only one side thereof which are secured in a retainer. The cover portions 46, 48 may be secured to the exterior of the core and/or retainers with an adhesive.

Figure 38:
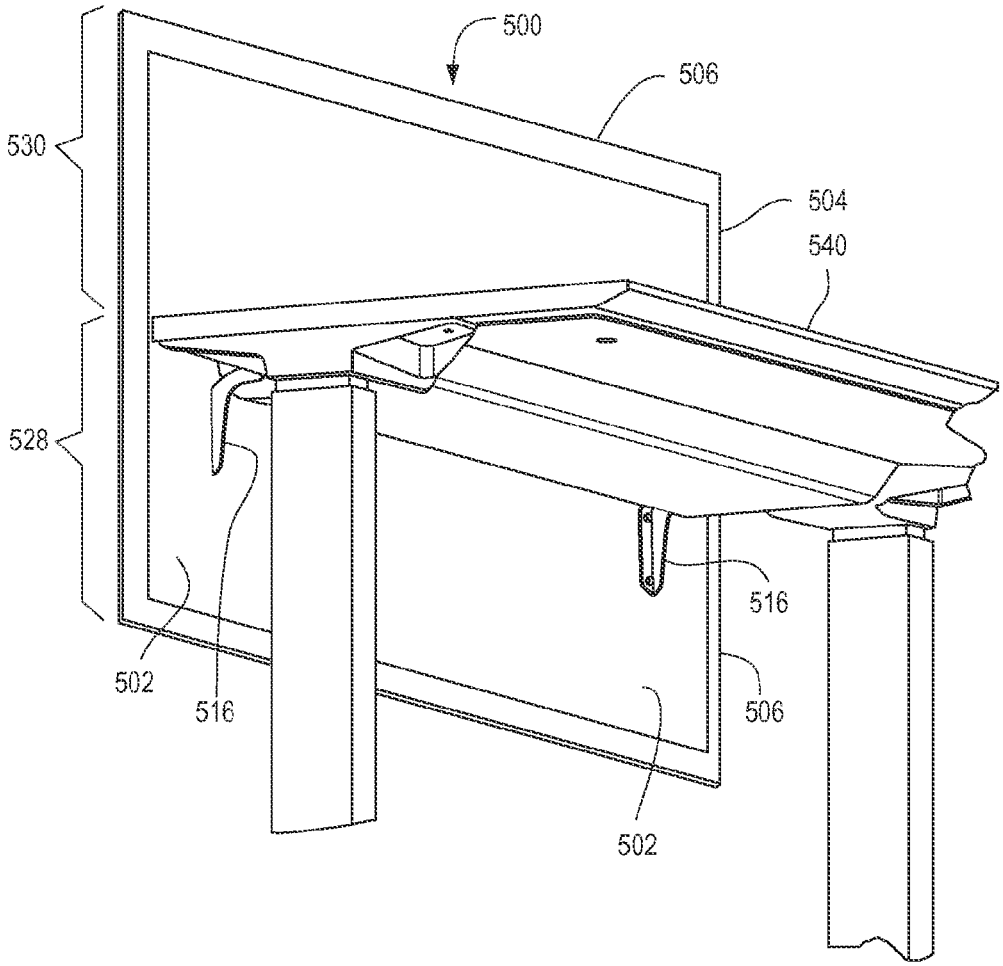
FIG. 38 is a perspective view of another screen assembly.
Figure 39:
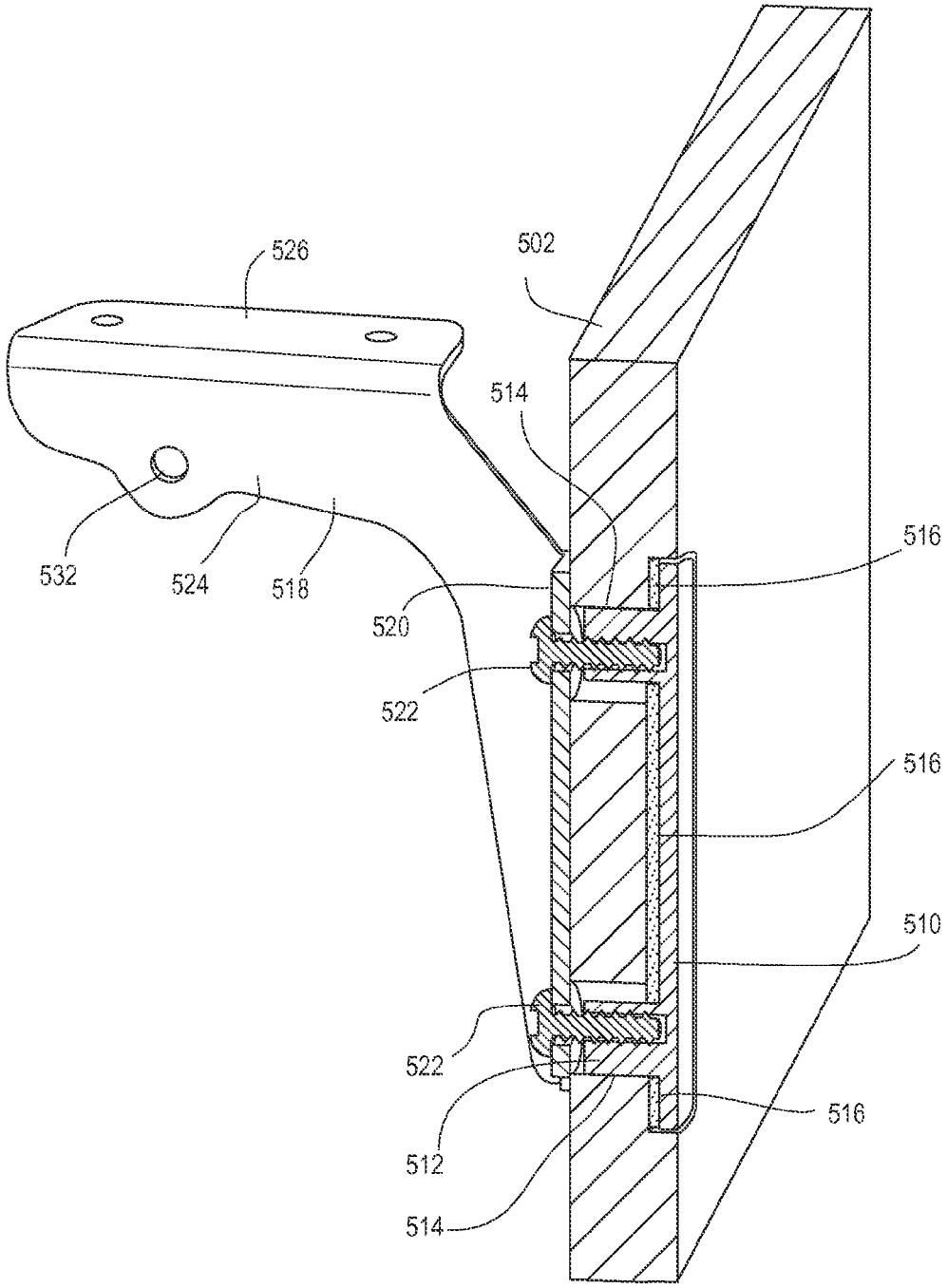
FIG. 39 is a partial cut-away section of the screen assembly shown in FIG. 38.
Figure 40:
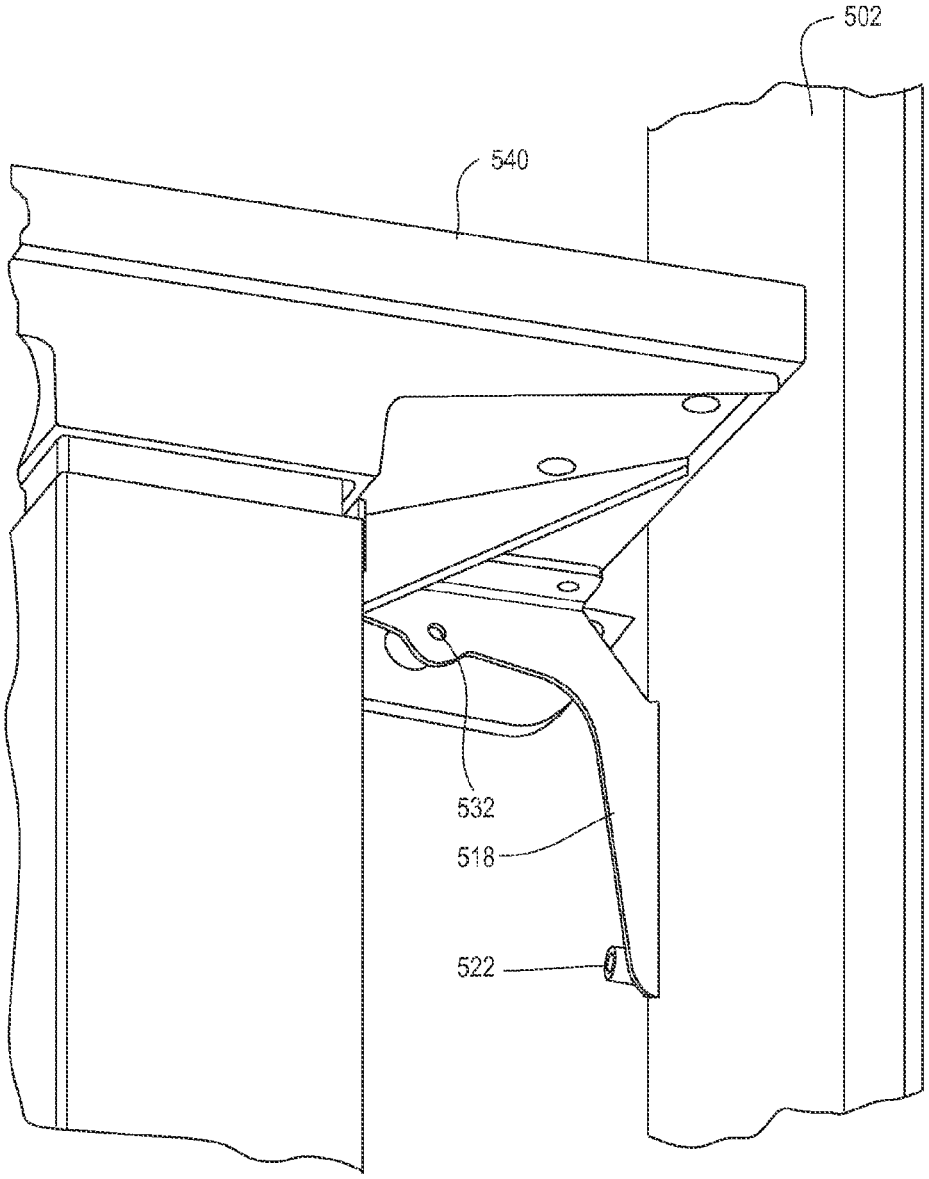
FIG. 40 is a partial cut-away section of the screen assembly shown in FIG. 38.
Figure 41:
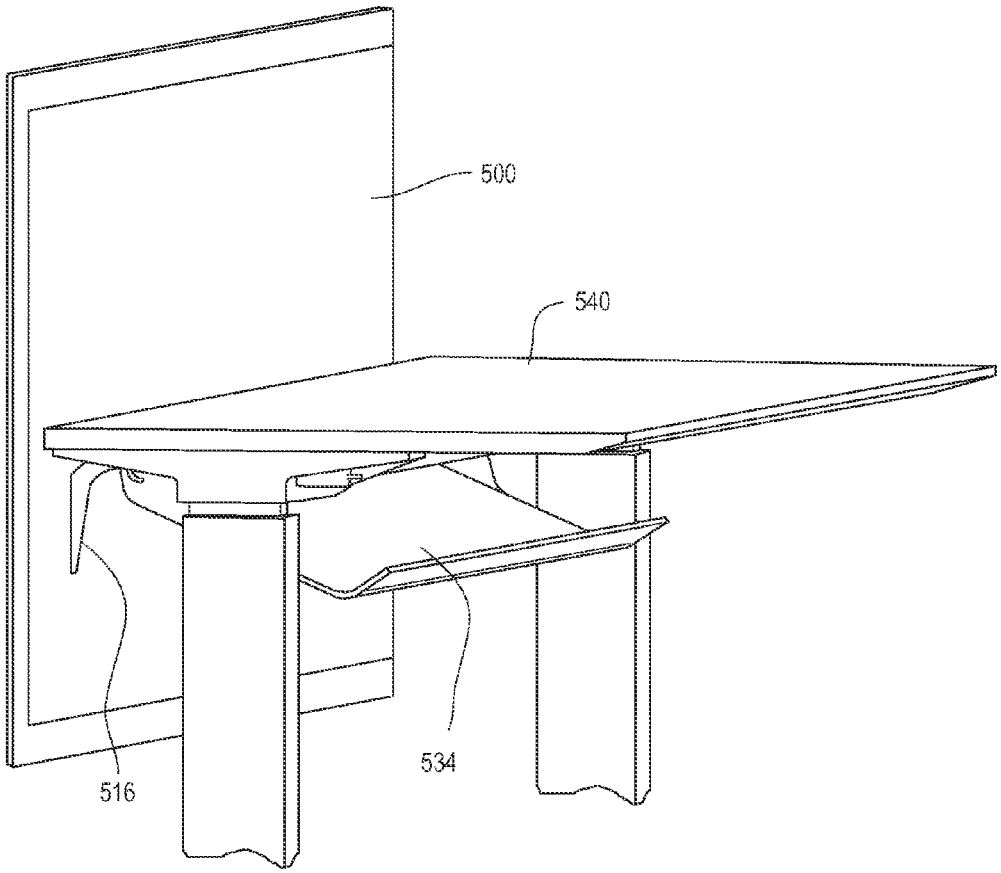
FIG. 41 is a perspective view of the screen assembly shown FIG. 38 with a wire tray in an open position.

Referring to FIGS. 38 and 39, another screen 500 is shown as having a core 502 formed from glass filed polyurethane foam. Linear edge treatments 506, formed for example as extrusions, and corner edge treatments 504, formed for example by injection molding, are positioned around the periphery of the core. In this embodiment the cover portions are omitted, with the core and edge treatments providing the finished appearance of the screen.

Screen Supports, Connectors and Accessories

Figure 29:
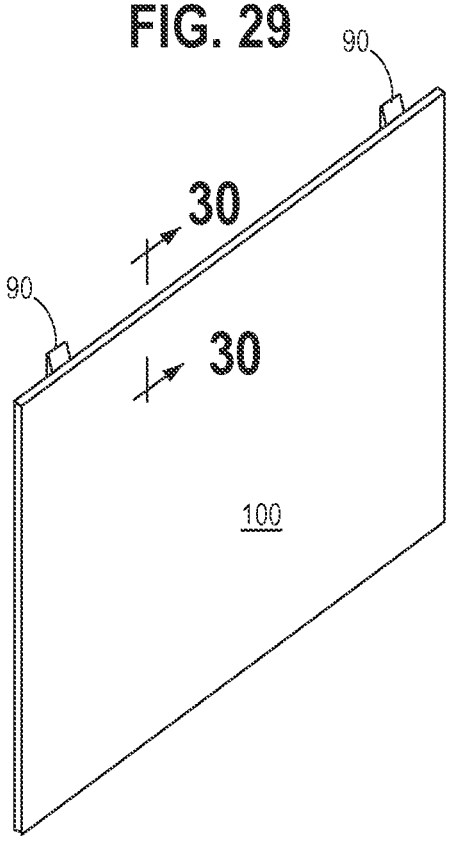
FIG. 29 is a perspective view of a screen overlay with a pair of accessory interface members secured thereto.
Figure 30:
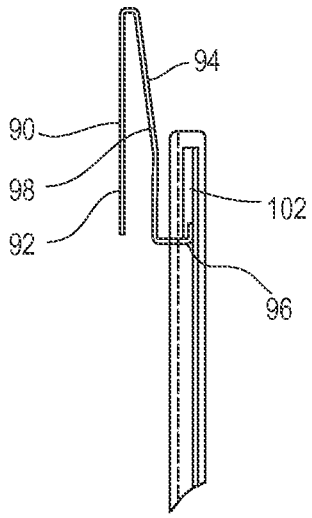
FIG. 30 is a cross-sectional view of the screen overlay taken along line 30-30 of FIG. 29.
Figure 31:
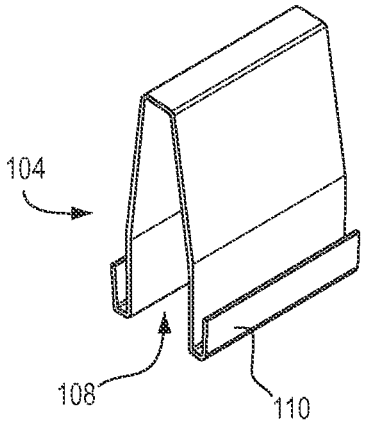
FIG. 31 is a perspective view of another embodiment of an accessory interface member.

Referring to FIGS. 29 and 30, one embodiment of the screen assembly includes an accessory interface member 90 having an insert portion 92, which may be disposed through the mouth 34 between the first and second cover portions 46, 48 and into the interior cavity 28 of the retainer. The accessory interface member may include a clip having a support portion 94 connected to the insert portion. In one embodiment, the support portion 94 overlies at least one of the first and second cover portions and has an interior surface 98 with a contour matching the exterior surface 40, 42 of a respective one of the first and second limbs 30, 32. The support may include a hook 96, tab or other accessory interface, such that it may engage and hold an accessory such has a screen overlay 100, shelving, storage and the like. The support may also be configured as a coat hook or other hanger. In one embodiment, the screen overlay 100 may be configured as a writable surface, such as a white board, or may be configured as a display surface, such as a monitor or projection surface. The hook 96 engages a channel 102 formed along an upper portion of the screen overlay. Referring to FIG. 31, an alternative interface member 104 may include an opposite support portions 106 defining a channel 108 that is received over an edge of the screen assembly, with the support portions extending inwardly along opposite sides of the screen. One or both of the support portions may be configured with an accessory interface 110, such as a hook.

Figure 4:
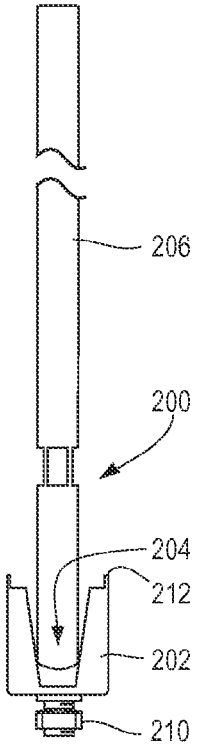
FIG. 4 is an enlarged end view of a screen support.
Figure 6:
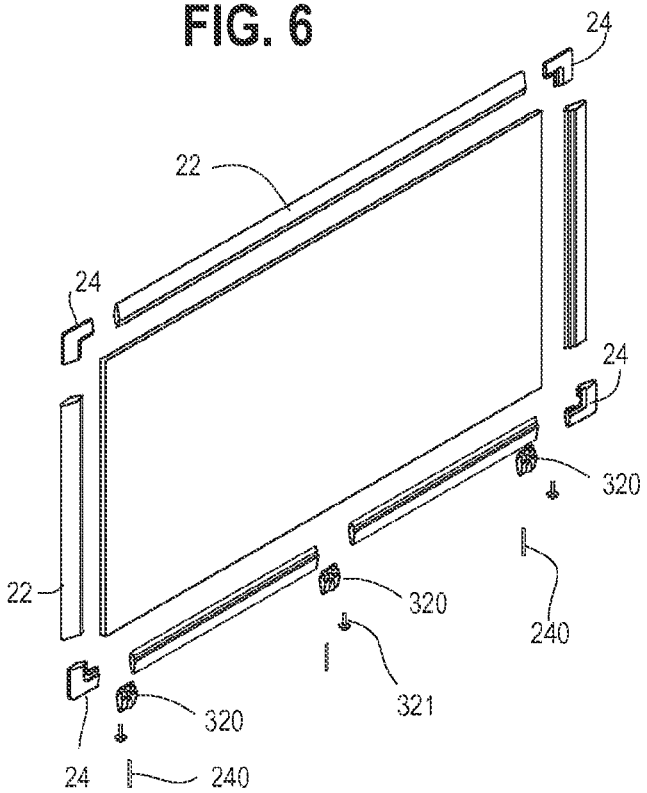
FIG. 6 is an exploded view of another embodiment of a screen assembly.
Figure 5:
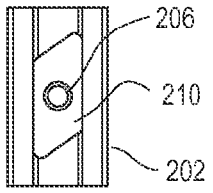
FIG. 5 is a bottom view of the screen support shown in FIG. 4.

Referring to FIGS. 2, 4 and 5, a screen support 200 includes a support block 202 having a cavity 204 shaped to receive a portion of the retainer 20, and in particular the first and second limbs 30, 32 of the retainer coupled to the bottom edge, in cavity. The screen support further includes a bayonet 206 extending upwardly from the support block into the core 4. The retainer may include portions spaced apart as shown in FIG. 2 with spaces 208 therebetween to permit passage of the bayonet 206. A lock member 210, shaped as a parallelogram, is rotatable and threadably secured to the bottom of the bayonet 206, which has a threaded end portion extending through the support block. The lock member is rotatable between an unlocked position, wherein the lock member is oriented along the length of the screen, and a locked position, wherein the lock member is oriented orthogonal to the length of the screen. A T-shaped socket or other recess (not shown) is positioned on an adjacent component, such as a worksurface or support wall, to receive the lock member, wherein the screen can be secured to the component. The support block may include an upstanding wall 212, which engages a lower edge of the screen overlay member 100.

Figure 7:
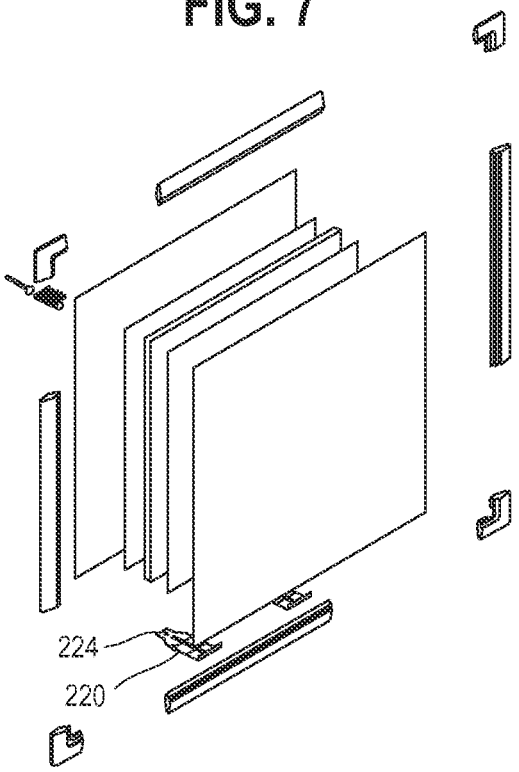
FIG. 7 is an exploded view of another embodiment of a screen assembly.
Figure 8:
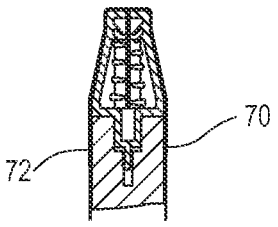
FIG. 8 is a cross-sectional view of an edge portion of the screen assembly shown in FIG. 7.
Figure 9:
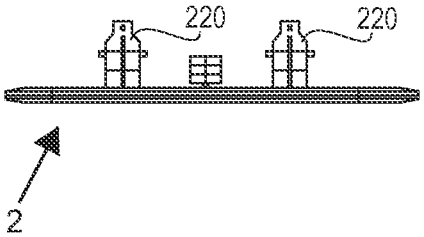
FIG. 9 is a top view of one embodiment of a screen assembly.
Figure 10:
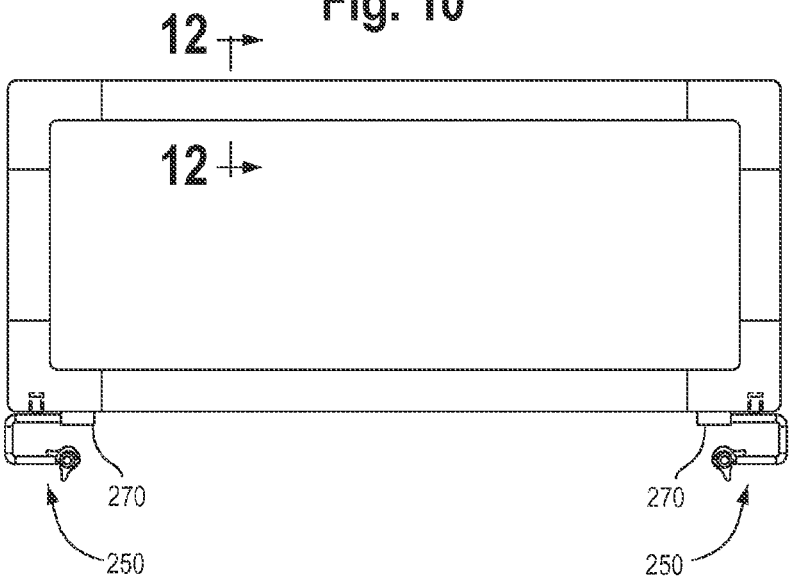
FIG. 10 is side view of a screen assembly with another embodiment of a screen assembly.
Figure 34:
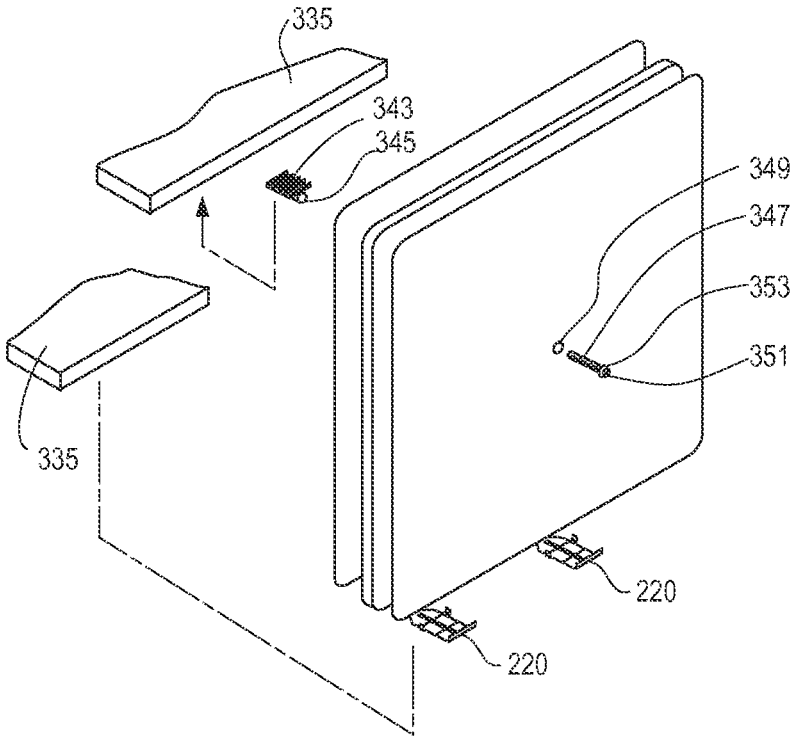
FIG. 34 is an exploded perspective view of a push pin assembly.

In an alternative embodiment, shown in FIGS. 7, 9 and 34, a screen support 220 includes a base member having a foot portion 224 and an upwardly extending insert portion 222 disposed through the mouth 34 of the retainer 20 between first and second cover portions and into the interior cavity between said first and second limbs. The foot portion 224 may be secured to an adjacent base structure, such as a chair or worksurface 335.

Figure 11:
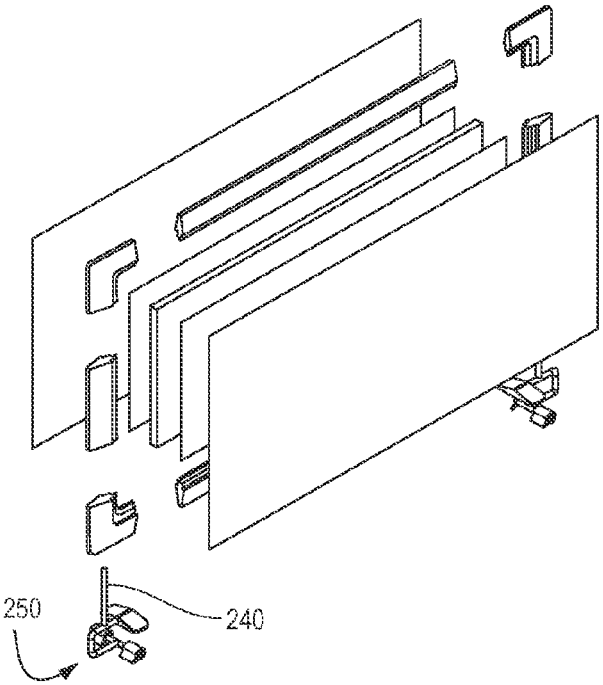
FIG. 11 is an exploded view of the screen assembly sown in FIG. 10.
Figure 12:
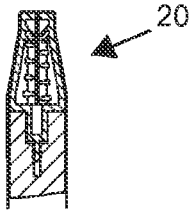
FIG. 12 is a cross-sectional view of an edge portion of the screen assembly taken along line 12-12 FIG. 10.
Figure 13:
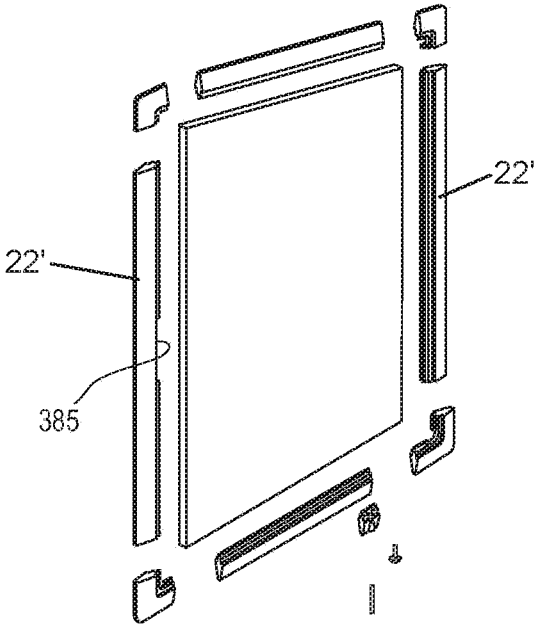
FIG. 13 is an exploded perspective view of another embodiment of screen assembly.
Figure 14:
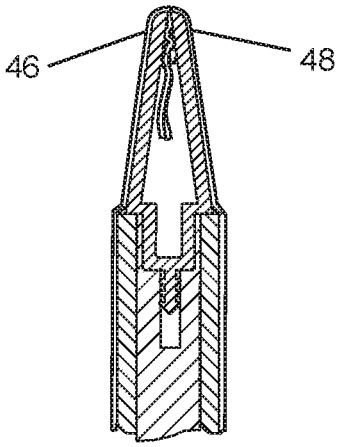
FIG. 14 is a cross-sectional view of an edge portion of the screen assembly shown in FIG. 13.
Figure 19:
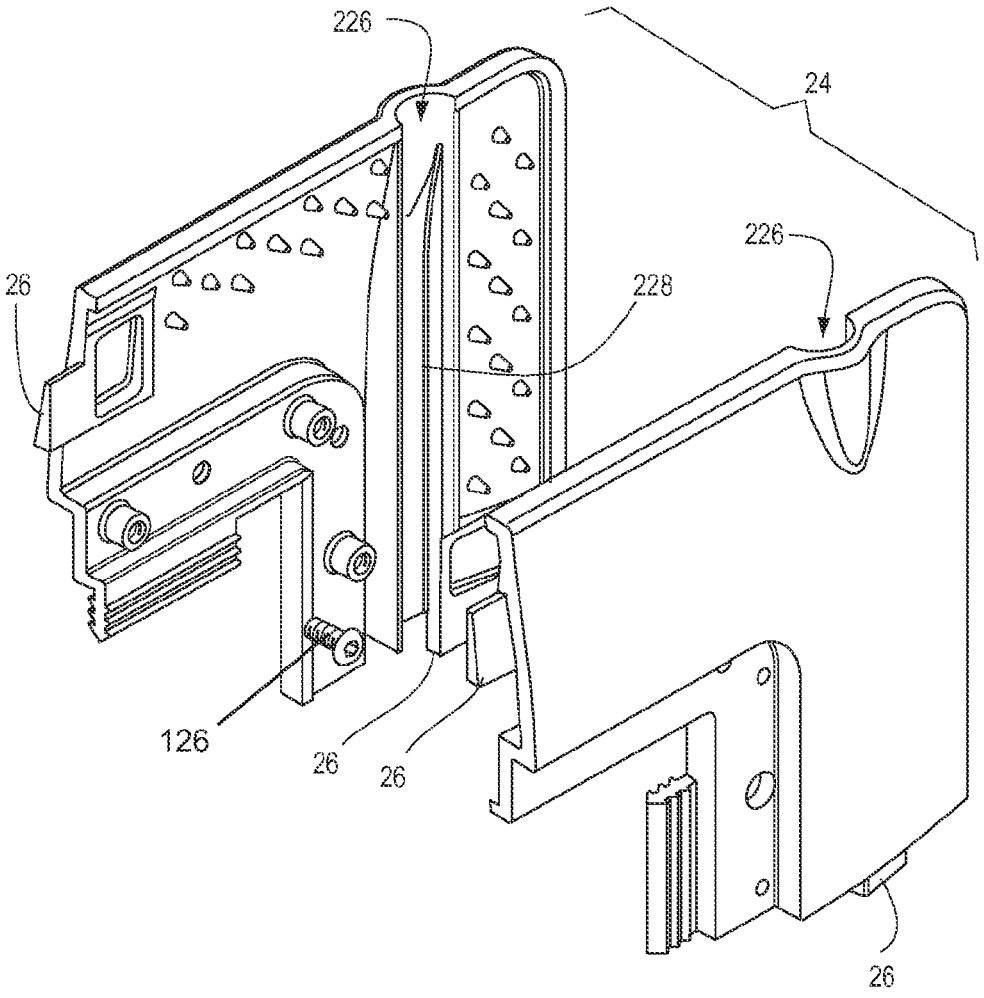
FIG. 19 is an exploded perspective view of another embodiment of a corner retainer.
Figure 20:
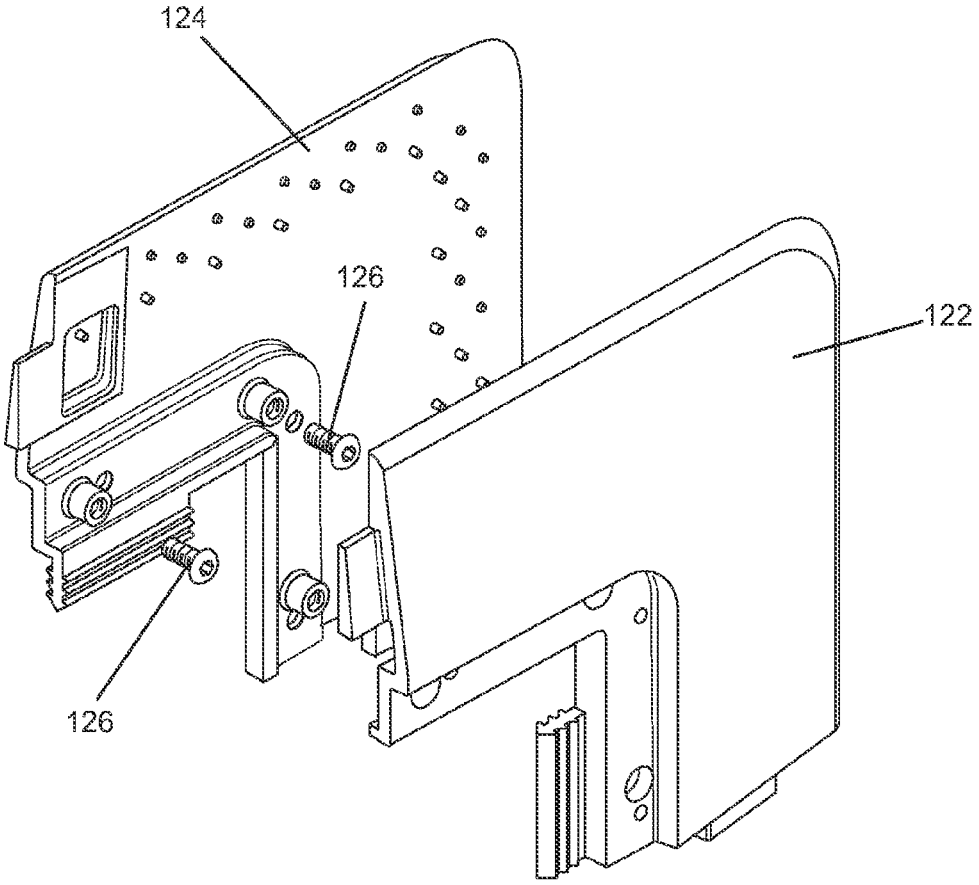
FIG. 20 is an exploded perspective view of another embodiment of a corner retainer.
Figure 21:
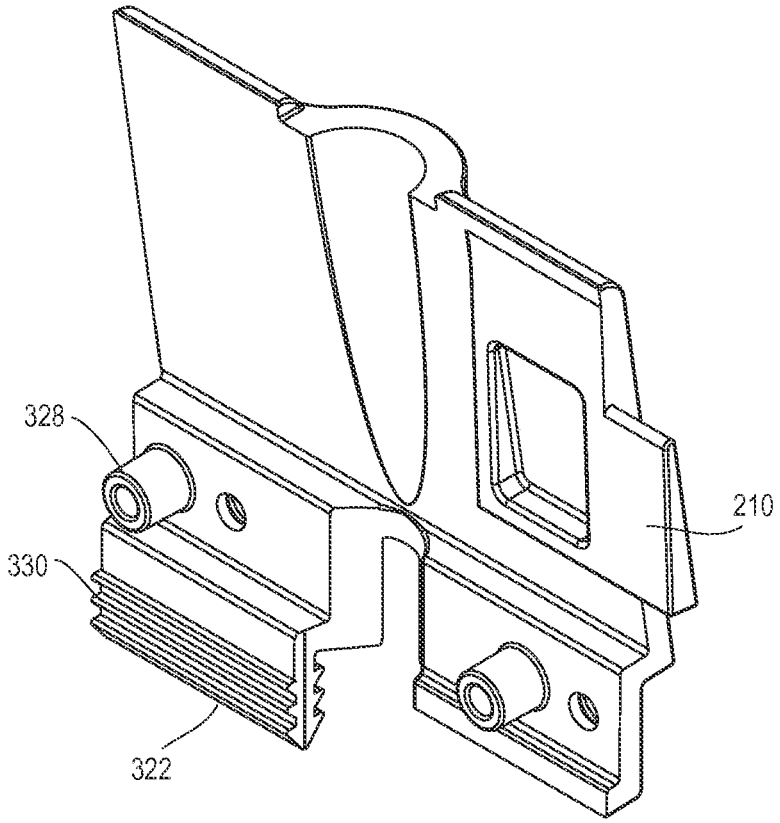
FIG. 21 is a perspective view of a cover retainer piece.
Figure 22:
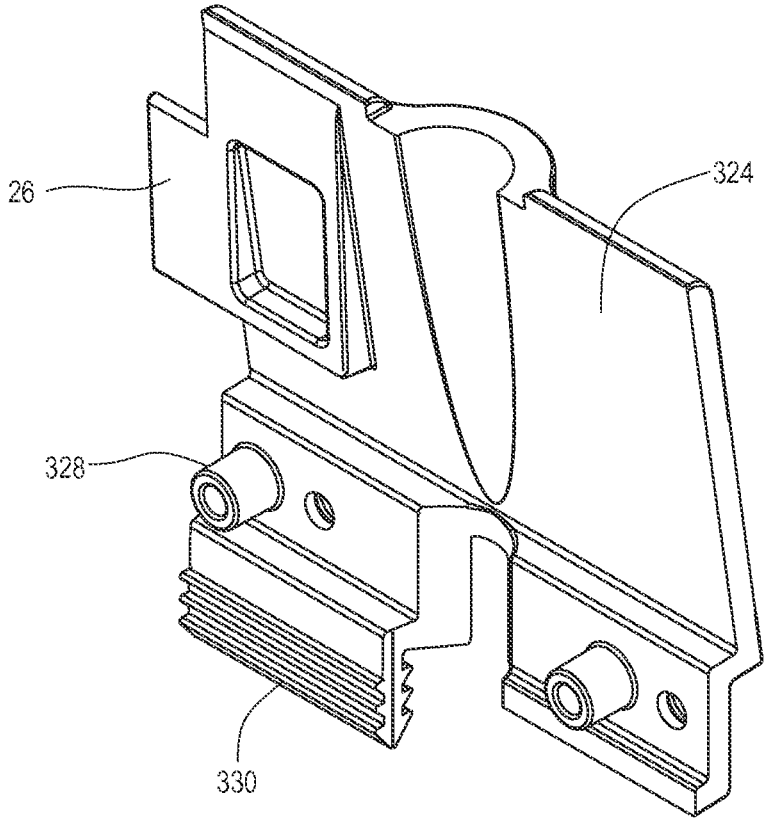
FIG. 22 is a perspective view of another cover retainer piece configured to mate with the cover retainer piece of FIG. 21.
Figure 23:
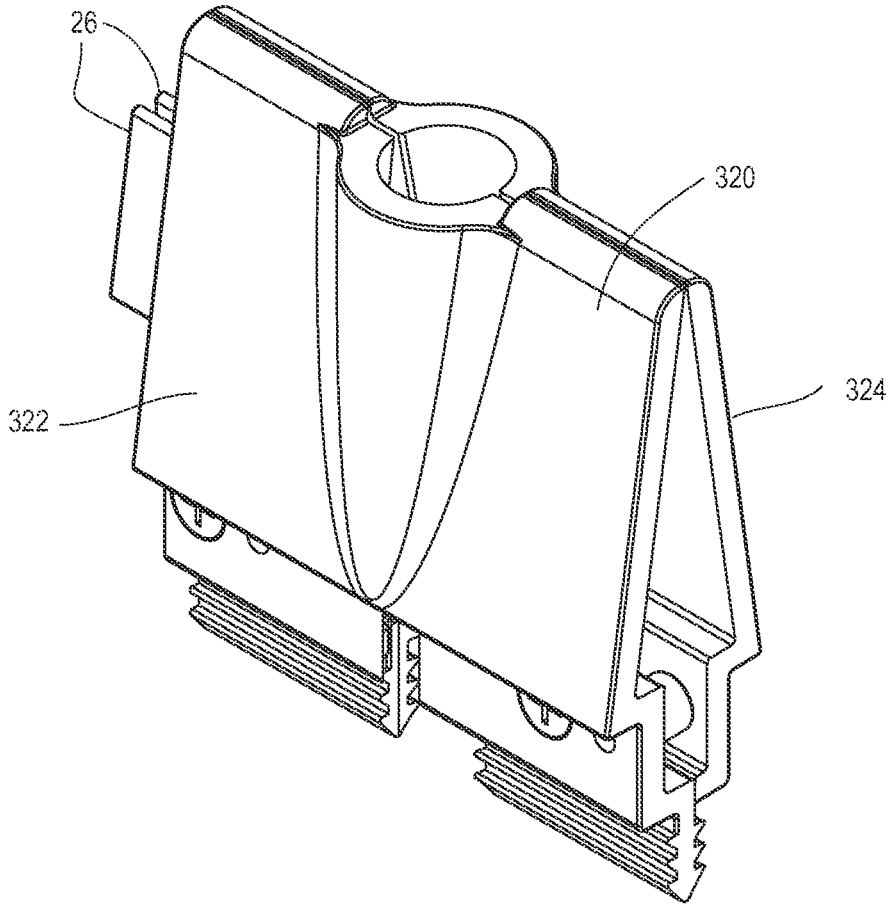
FIG. 23 is a perspective assembly view of the cover retainer pieces of FIGS. 21 and 22.
Figure 24:
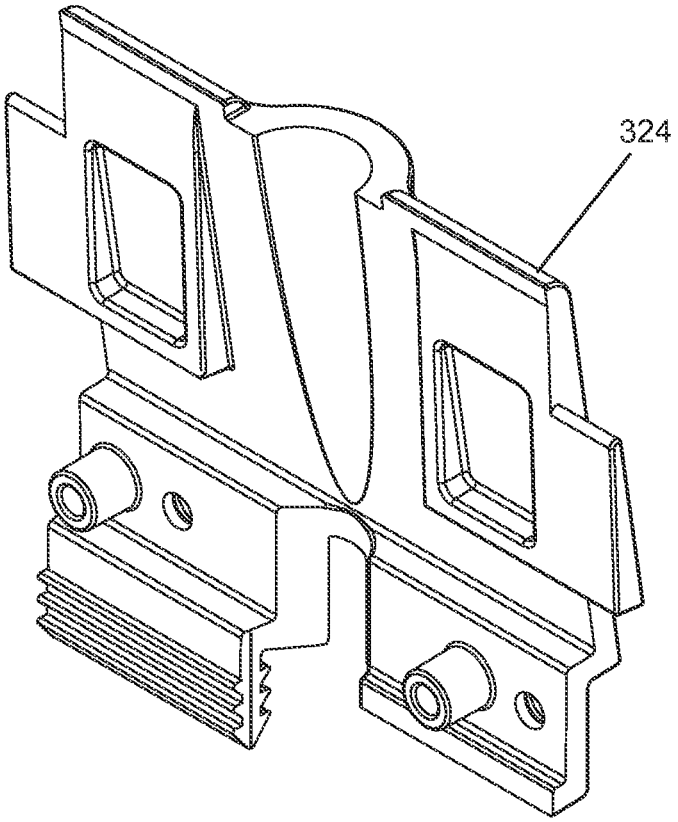
FIG. 24 is a perspective view of another embodiment of a cover retainer piece.
Figure 25:
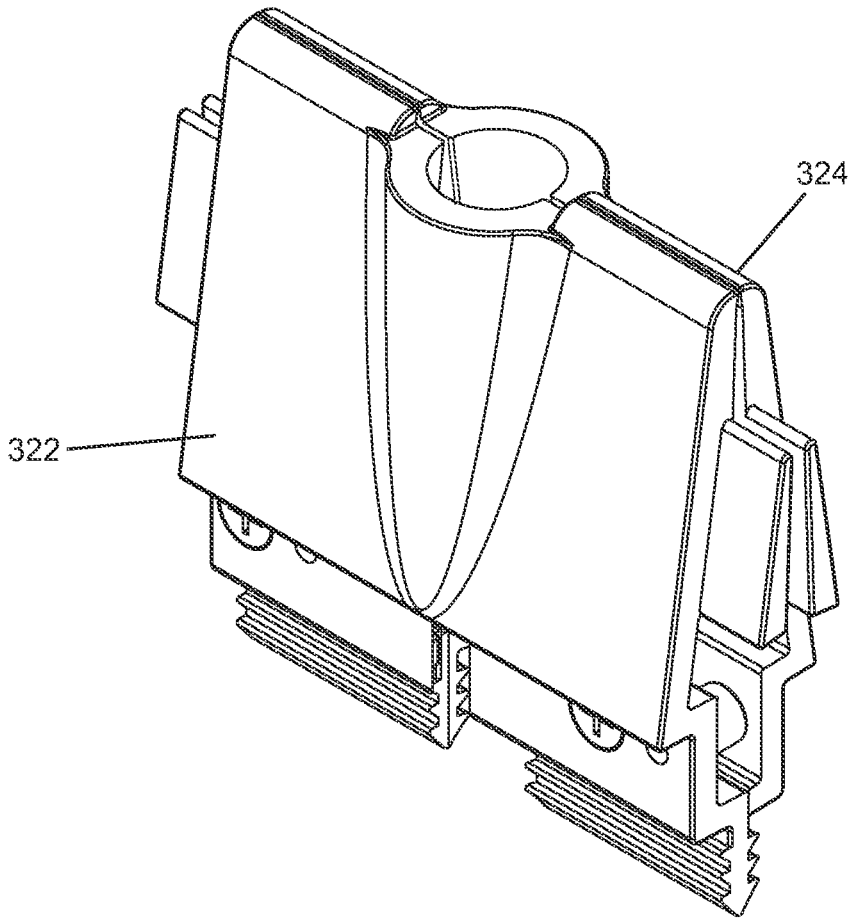
FIG. 25 is a perspective assembly view of the cover retainer pieces of FIG. 24.
Figure 26:
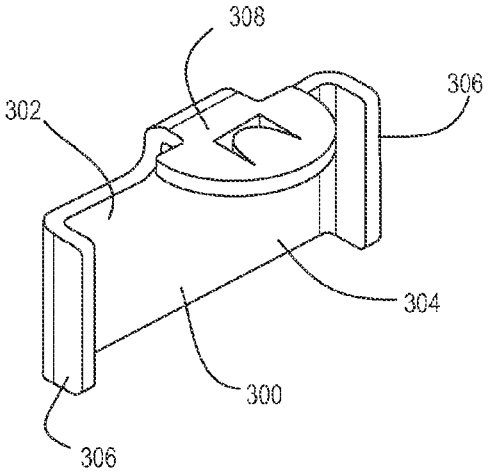
FIG. 26 is a perspective view of an in-line connector.
Figure 27:
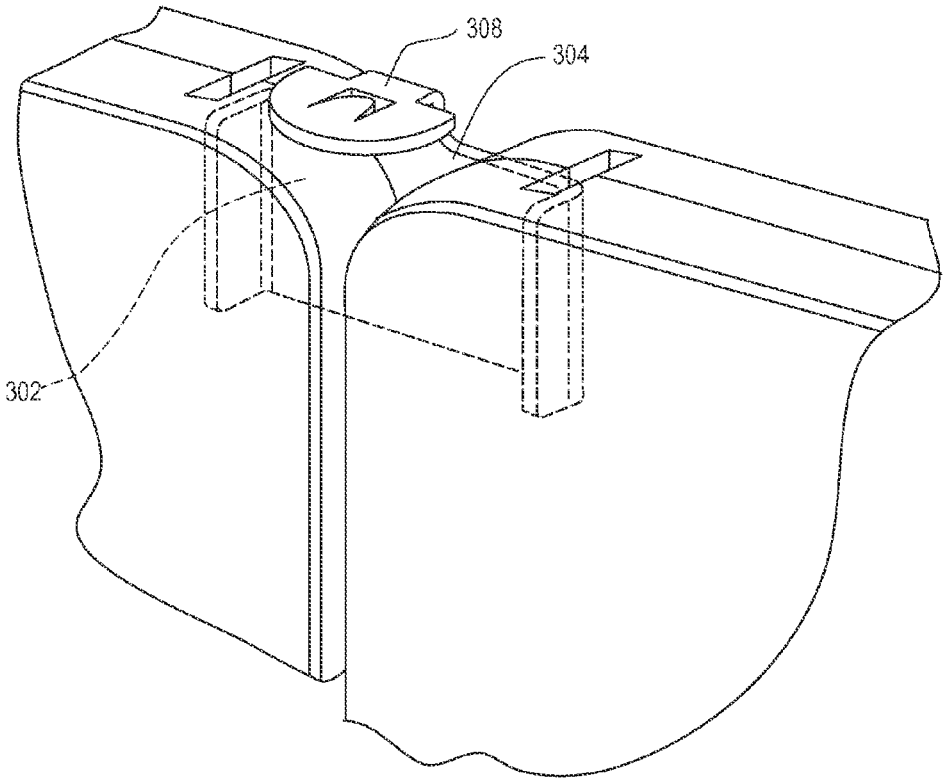
FIG. 27 is a partial view of a pair of screen assemblies being connected with the in-line connector of claim 26.
Figure 28:
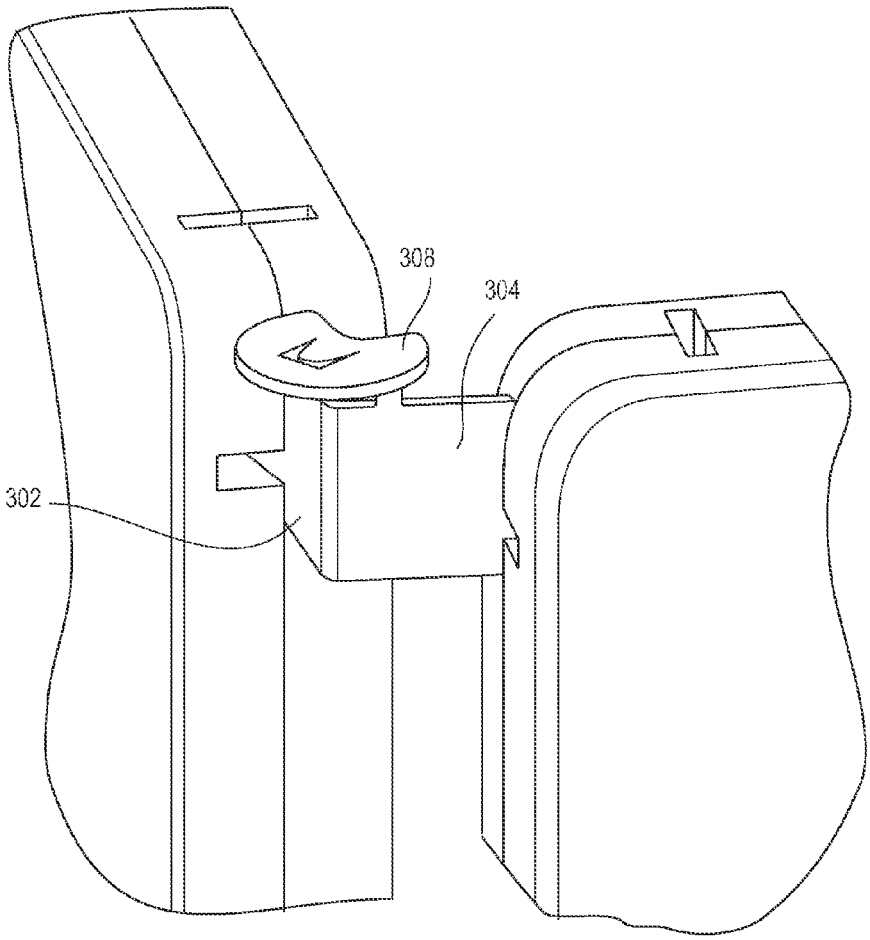
FIG. 28 is a partial view of a pair of screen assemblies being connected with an orthogonal connector.

In another embodiment, shown in FIGS. 6, 21-25, two-piece retainers 320, 322, 324 are shown as including first and second limbs defining an opening 226 and a socket 228 shaped to receive a stanchion, forming part of a screen support. The retainers may be formed as a corner piece or as a linear piece. A stanchion 240 may be supported entirely by the retainer as shown in FIGS. 11 and 19, or may extend through the retainer and into an opening formed in the core as shown in FIGS. 21-25. A glide 321, or other floor engaging member, may be secured to the bottom of the stanchion 240, and may be height adjustable relative thereto to provide leveling capabilities. The retainers includes insert portion 26, which are used to align the retainers with adjacent retainers.

Figure 32:
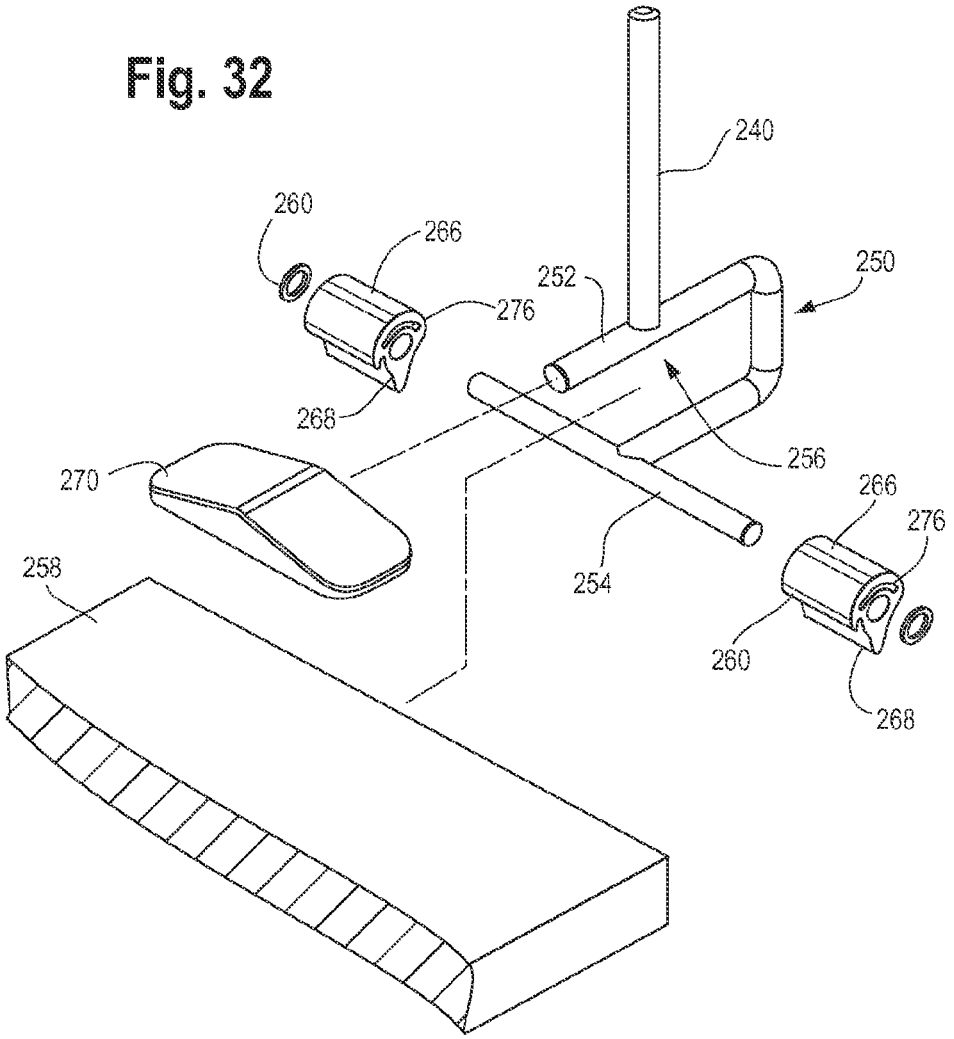
FIG. 32 is an exploded view of one embodiment of a screen support.
Figure 33:
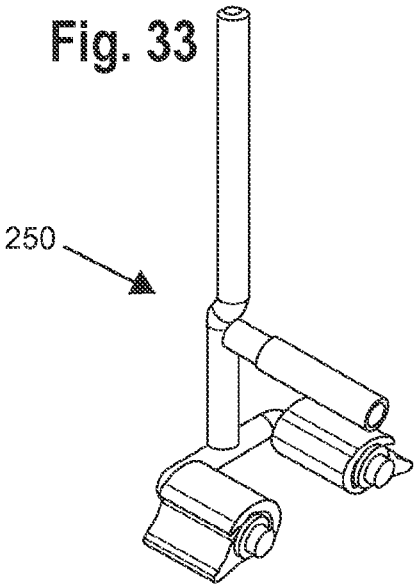
FIG. 33 is a perspective view of another embodiment of a screen support.

Referring to FIGS. 32 and 33, a screen support includes a frame 250 connected to a support member, such as the stanchion 240. The frame defines upper and lower clamping members 252, 254 spaced apart and defining a gap 256 therebetween. The gap 256 is sized so as to be adapted to receive a clamping surface, such as a table top 258 therein. One or more cams 260 (shown as two) are rotatably mounted on one or both of the upper or lower clamping members 254. The same has an outer clamping surface 266. The cams 260 are rotatable between an unclamped position wherein the outer clamping surface 266 is spaced a first distance from the other of the upper or lower clamping members 252, including a pad 270 mounted thereon, and a clamped position wherein the outer clamping surface is spaced a second distance from the other of the upper or lower clamping members 252, 270. The second distance is less than said first distance. The pad 270 may also support a bottom edge of the screen. The cam includes a grippable handle portion 268. The cam also includes an interior cavity 276 positioned between the outer clamping surface and a bore defining an axis of rotation, which thereby increase the resiliency of the cam.

Figure 35:
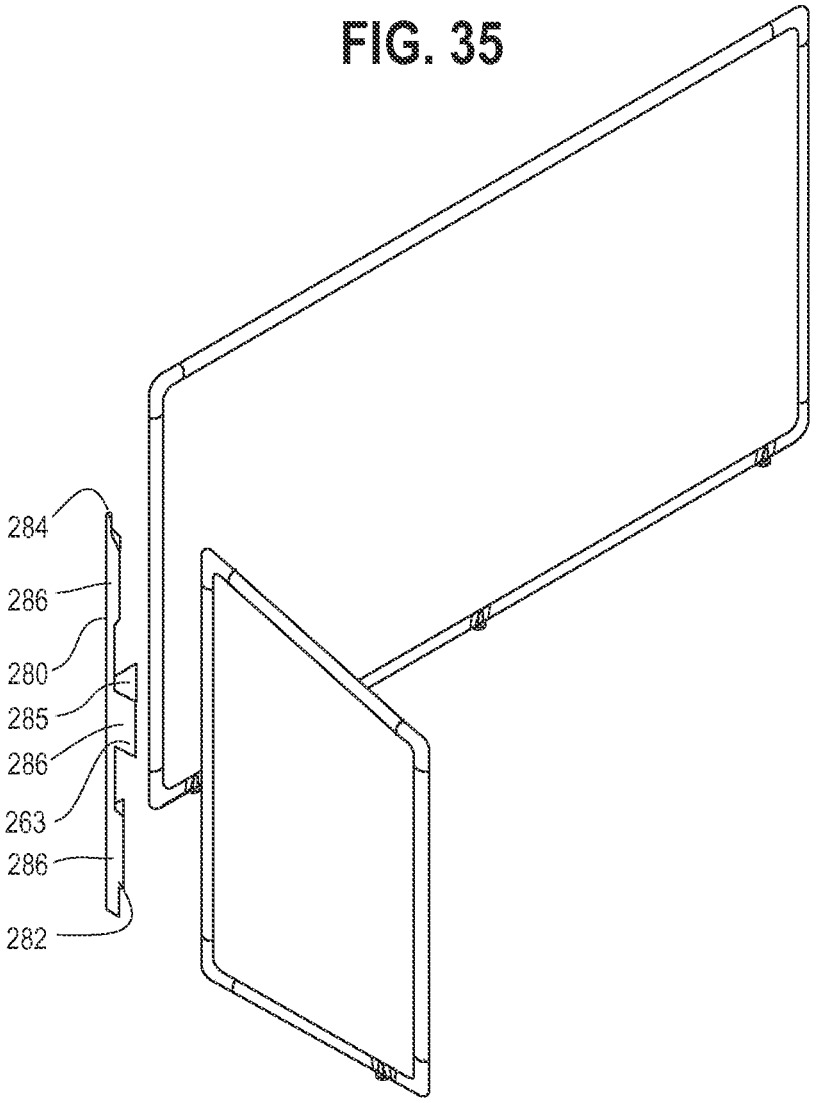
FIG. 35 is an exploded perspective view of another embodiment of a screen assembly.
Figure 36:
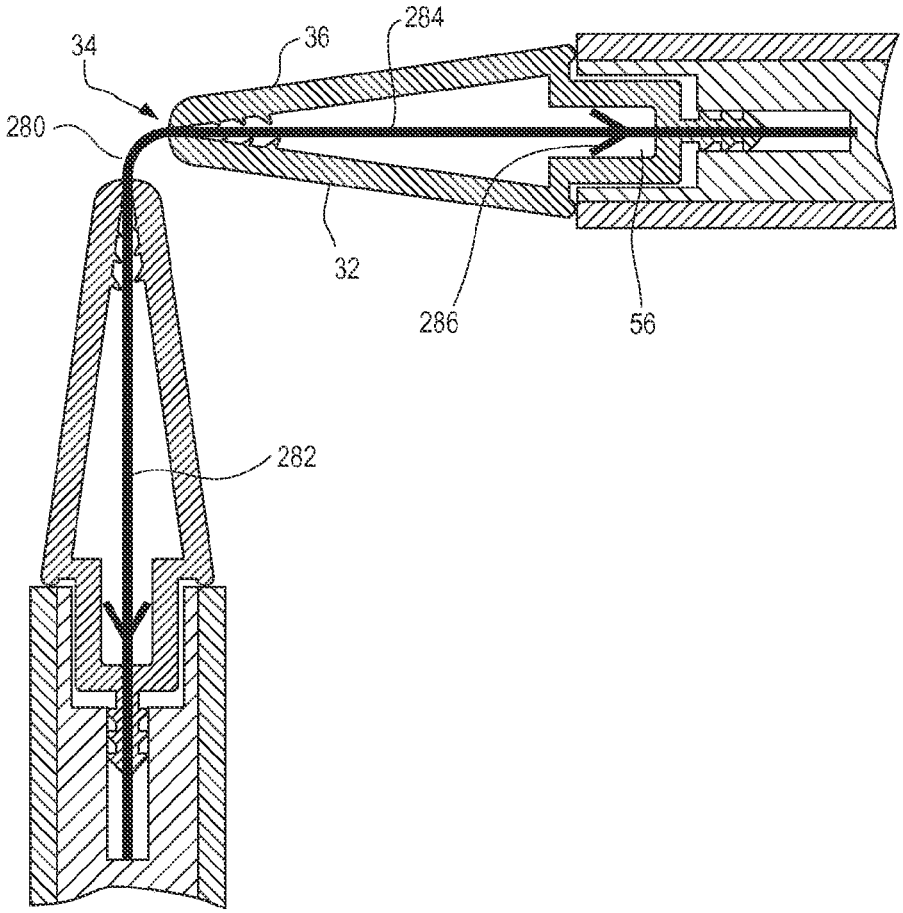
FIG. 36 is cross-sectional view of the screen-to-screen attachment for the screen assembly shown in FIG. 35.
Figure 37:
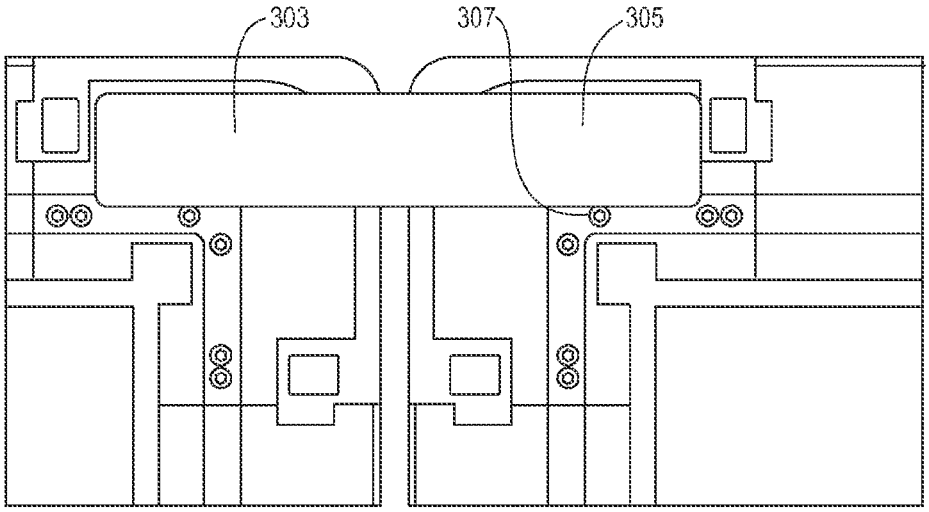
FIG. 37 is a cut-away view of two adjacent screens joined with a connector member.

Referring to FIGS. 35 and 36, a connector 280 is configured to connect edge portions of adjacent screen assemblies 2, for example adjacent side edges. The connector 280 includes first and second insert portions 282, 284 received through the mouths 34 of adjacent edge treatments of the first and second screens. The edge treatments, or retainers, each include a channel 56, with the first and second insert portions each having at least one one-way gripping member 286, shown as a resilient barb, engaging a surface of the channel. Each of the insert portions 282, 284 may include an elongated tongue 283, 284, which is inserted through a cut 385 in the edge treatments, shown for example in FIG. 13.

Referring to FIGS. 35 and 36, a connector 280 is configured to connect edge portions of adjacent screen assemblies 2, for example adjacent side edges. The connector 280 includes first and second insert portions 282, 284 received through the mouths 34 of adjacent edge treatments of the first and second screens. The edge treatments, or retainers, each include a channel 56, with the first and second insert portions each having at least one one-way gripping member 286, shown as a resilient barb, engaging a surface of the channel. Each of the insert portions 282, 284 may include an elongated tongue 283, 284, which is inserted through a cut 385 in the edge treatments 22', shown for example in FIG. 13.

Referring to FIG. 34, a push pin securement mechanism 341 is shown. A bracket 343 including a receiving member 345 is secured to a base 335, such as a chair, worksurface, desk, cabinet or other self-supporting structure. A push pin 347 may be inserted through an opening 349 in the middle of the panel and thereafter received in a socket formed in the receiving member 345. The push pin 347 includes a head portion 353 having a flange engaging the surface of the panel, and a release mechanism, e.g., detent, actuated by a push button 351 on the end of the pin. The release mechanism may be acutated to release the pin from the receiving member, such that the pin may be extracted and the panel removed.

Referring to FIGS. 38-41, a plurality of inserts 510 (shown as two) each have a flange embedded in one surface of the screen 500. The insert is secured with an adhesive 516, and includes a plurality of boss structures 512 (shown as two) extending from the flange into an opening 514 formed through the thickness of the core 502. A corresponding plurality of brackets 518 have a flange 520 engaging an opposite surface of the screen 500. A plurality of fasteners 522 extend through openings in the flange and engage the boss structures 512, with the core 502 being clamped between the brackets 518 and the inserts 510. The brackets include an upstanding arm 524 and mounting flange 526, which is secured to an adjacent base, such as a worksurface 540, with the screen being suspended above the ground, with a lower portion 528 of the screen positioned below the worksurface and providing a modesty screen, and an upper portion 530 extending above the worksurface and providing a privacy screen. The arm includes an opening 532, which provides a pivot mounting for a wire tray 534 pivotally mounted beneath the worksurface.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A screen assembly comprising:

a core having an edge and first and second opposite side surfaces;

a retainer coupled to said edge of said core and extending outwardly from said core, said retainer comprising first and second resilient limbs having respective edge portions defining a mouth between said respective edge portions, said first and second resilient limbs defining an interior cavity therebetween, and said first and second resilient limbs defining respective exterior surfaces, wherein said edge portions of said first and second resilient limbs are moveable toward and away from each other between a retention configuration and an insertion configuration, wherein said first and second limbs are biased toward said retention configuration to close said mouth; and first and second cover portions each having an edge, said first cover portion overlying said first opposite side surface of said core and said exterior surface of said first resilient limb, said second cover portion overlying said second opposite side surface of said core and said exterior surface of said second resilient limb, said first and second cover portions wrapping around said edge portions of said first and second limbs being disposed through said mouth such that said edges of said first and second cover portions are disposed in said interior cavity and the first and second cover portions directly engage one another, wherein said first and second resilient limbs retain said first and second cover portions therebetween.

2. The screen assembly of claim 1 wherein said core comprises a plurality of layers.

3. The screen assembly of claim 2 wherein at least one of said layers comprises a material capable of being pierced by a tack.

4. The screen assembly of claim 1 wherein said first and second limbs each comprise gripping members extending inwardly into said interior cavity, said gripping members of said first and second limbs engaging said first and second cover portions respectively.

5. The screen assembly of claim 4 wherein said gripping members are oriented to provide one-way engagement of said first and second cover portions, wherein said gripping members are configured to permit insertion of said first and second cover portions into said interior cavity, and to prevent removal of said first and second cover portions from said interior cavity.

6. The screen assembly of claim 4 wherein the gripping members of said first limb are staggered relative to said gripping members of said second limb.

7. The screen assembly of claim 1 wherein said exterior surfaces of said limbs are tapered from said opposite side surfaces of said core to said edge portions of said limbs so that a distance between the exterior surfaces decreases.

8. The screen assembly of claim 7 wherein said exterior surfaces are substantially planar.

9. The screen assembly of claim 7 wherein said exterior surfaces are non-planar.

10. The screen assembly of claim 1 wherein said retainer comprises a base, wherein said first and second limbs extend outwardly from said base.

11. The screen assembly of claim 10 wherein said core comprises an opening formed in said edge, wherein said base comprises an insert member disposed in said opening.

12. The screen assembly of claim 11 wherein said opening comprises a channel.

13. The screen assembly of claim 12 wherein said channel comprises a first channel having a first width, and a second channel continuous with said first channel and having a second width, wherein said second width is less than said first width.

14. The screen assembly of claim 13 wherein said base comprises a first portion disposed in said first channel and an anchor member disposed in said second channel.

15. The screen assembly of claim 1 wherein said first and second limbs are integrally formed.

16. The screen assembly of claim 1 wherein said first and second limbs define a corner piece with first and second orthogonal mouth portions.

17. The screen assembly of claim 1 wherein said edge of said core defines an outer periphery of said core, and wherein said retainer comprises a plurality of retainers coupled to said edge around said outer periphery.

18. The screen assembly of claim 17 wherein said plurality of retainers comprises upper and lower retainer members, opposite side retainer members and corner retainer members positioned between said upper retainer member and said side retainer members and between said lower retainer member and said side retainer members.

19. The screen assembly of claim 18 wherein said corner retainer members and said upper and lower retainer members are connected.

20. The screen assembly of claim 19 wherein one of said corner retainer members and said upper and lower retainer members comprise an insert portion and the other of said corner retainer members and said upper and lower retainer members comprise an interior cavity, wherein said insert portion is disposed in said interior cavity.

* * * * *